US005951346A

United States Patent [19]

Woodall, Jr.

[11] Patent Number: 5,951,346

[45] Date of Patent: Sep. 14, 1999

[54] AIR-DELIVERED POSITION MARKING DEVICE AND METHOD

[75] Inventor: Robert C. Woodall, Jr., Lynn Haven, Fla.

[73] Assignee: The United States of America as represented by the Secretary of the Navy, Washington, D.C.

[21] Appl. No.: 08/986,983

[22] Filed: Dec. 8, 1997

[51] Int. Cl.[6] ..... B63B 22/08

[52] U.S. Cl. ..... 441/7; 367/4; 441/11

[58] Field of Search ..... 441/6, 7, 9, 11, 441/23, 32, 33; 367/4

[56] References Cited

U.S. PATENT DOCUMENTS 4,193,057 3/1980 Bennett et al. ..... 441/13
4,999,816 3/1991 Dale et al. ..... 441/33
5,741,167 4/1998 Hagerty ..... 441/13

*Primary Examiner*—Jesus D. Sotelo
*Attorney, Agent, or Firm*—Harvey A. Gilbert; Donald G. Peck

[57] ABSTRACT

An air-deliverable global positioning system (GPS) position marking device and method involves the operations of providing an air-deliverable GPS position marking device, launching the device into flight through the air to a desired location, arming the device in response to launching the device into flight, firing a detonation mechanism contained in the device when the device is at the desired location after receipt of a magneto-inductive transmission so as to generate a predetermined pressure in an interior chamber of the device that causes ejection of a payload assembly from the interior chamber, initiates inflation of an inflatable flotation body of the payload assembly, and initiates communications between a GPS receiver and transmitter unit in the payload assembly and a remote station to determine the position of the position marking device at the desired location.

19 Claims, 3 Drawing Sheets

AIR-DELIVERED POSITION MARKING DEVICE AND METHOD

CROSS-REFERENCE TO RELATED APPLICATION

The subject matter of this application is related to that of U.S. Pat. No. 5,661,258 issued Aug. 26, 1997, entitled "Air-Delivered Ordnance Explosive Mine And Obstacle Clearance Method" by Felipe A. Garcia and Robert C. Woodall, Jr.

BACKGROUND OF THE INVENTION

1. Field of the Invention

The present invention generally relates to a position marking device and, more particularly, is concerned with an air-delivered position marking device and method for marking positions and locations on land or in the sea.

2. Description of the Prior Art

An amphibious assault operation is a dangerous military mission which can easily result in a high rate of casualties. It is imperative, therefore, that a cleared lane through mine-obstacle fields be marked such that forces can land on a beach without suffering casualties by straying into uncleared areas.

Currently, the systems available for marking amphibious assault lanes are limited. Some systems require the targeted beach to be secured by friendly forces prior to a lane marking system being deployed. Other lane marking systems make use of an aircraft sector light placed on the beach to aid navigation. There exists no lane marking device that can be placed simultaneously instride from the sea with the ordnance used to breach a lane and mark its location.

Consequently, a need exists for an air-delivered position marking device especially one for use in marking a channel for an amphibious assault which will overcome the shortcomings of the prior art without introducing new ones in their place.

SUMMARY OF THE INVENTION

The present invention provides an air-delivered position marking device and method which are designed to satisfy the aforementioned need. The position marking device and method are capable of marking positions or locations on land or in the sea. The primary purpose of the position marking device is to mark areas in the sea and on land where ordnance has been placed.

Although not so limited, the air-delivered position marking device and method of the present invention are particularly suited for use in visible marking of an amphibious path through a navigable sea channel to be cleared by the method invention disclosed in the patent application cross-referenced above. Preferably, the position marking device and method utilize global positioning system (GPS) technology which is shock hardened for impact. The use of GPS technology allows for highly accurate position marking. Navigable sea channel clearance ordnance is emplaced by aircraft in accordance with the method invention of the cross-reference application so that upon remote activation, the ordnance detonates to create an amphibious assault lane through mine and obstacle fields. The position marking device of the present invention can provide the GPS marker mentioned in the cross-reference application which is aircraft emplaced, either GP Bomb or standoff delivery, i.e., Longshots™, or parafoil, along with the mine/obstacle clearance ordnance in order to mark the coordinates of the assault lane prior to or after system detonation.

Accordingly, the present invention is directed to an air-delivered position marking device which comprises: (a) an elongated body defining an interior chamber; (b) a payload assembly disposed in the interior chamber and including an inflatable flotation body, an actuatable mechanism coupled to the flotation body for inflating the flotation body, a global positioning system (GPS) receiver and transmitter unit, an electrical power source coupled to the GPS receiver and transmitter unit and being activatable for supplying electrical power to operate the GPS receiver and transmitter unit; and (c) a detonatable mechanism connected to the elongated body and provided in communication with the interior chamber thereof such that firing of the detonatable mechanism generates a predetermined pressure in the interior chamber that causes ejection of the payload assembly therefrom, actuates the actuatable mechanism to initiate inflation of the flotation body, and activates the electrical power source to initiate communications between the GPS receiver and transmitter unit and a remote station to determine the position of the position marking device at the desired location.

The payload assembly also includes a closure detachably attached to the elongated body so as to close a rear end of the interior chamber and to detach therefrom in response to generation of the predetermined pressure in the interior chamber of the elongated body. The payload assembly further includes an elongated support member disposed in the interior chamber and mounting the inflatable flotation body, actuatable mechanism, GPS receiver and transmitter unit, electrical power source, and closure. The payload assembly further includes a self-destruct charge connected to the GPS receiver and transmitter unit and a destruct timer connected to the self-destruct charge and being actuatable in response to generation of the pressure in the interior chamber of the elongated body to detonate the self-destruct charge and thereby destroy the GPS receiver and transmitter unit after the lapse of a predetermined period of time after actuation of the destruct timer in response to generation of the pressure. The self-destruct charge and destruct timer are mounted to the elongated support member of the payload assembly.

The present invention also is directed to a GPS position marking method which comprises the steps of: (a) providing an air-deliverable position marking device; (b) launching the device into flight through the air to a desired location; (c) arming the device in response to launching the device into flight; (d) firing a detonation mechanism in the device when the device is at the desired location so as to generate a predetermined pressure in an interior chamber of the device that contains a payload assembly; and (e) in response to generation of the predetermined pressure in the interior chamber, ejecting the payload assembly from the interior chamber, initiating inflation of an flotation body on the payload assembly, and initiating communications between a GPS receiver and transmitter unit of the payload assembly and a remote station to determine the position of the position marking device at the desired location.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIGS. 4A and 4B together constitute a detailed flow chart of the operational steps in the deployment of the position marking device in accordance with the method of the present invention.

DETAILED DESCRIPTION OF THE INVENTION

Figure 2:
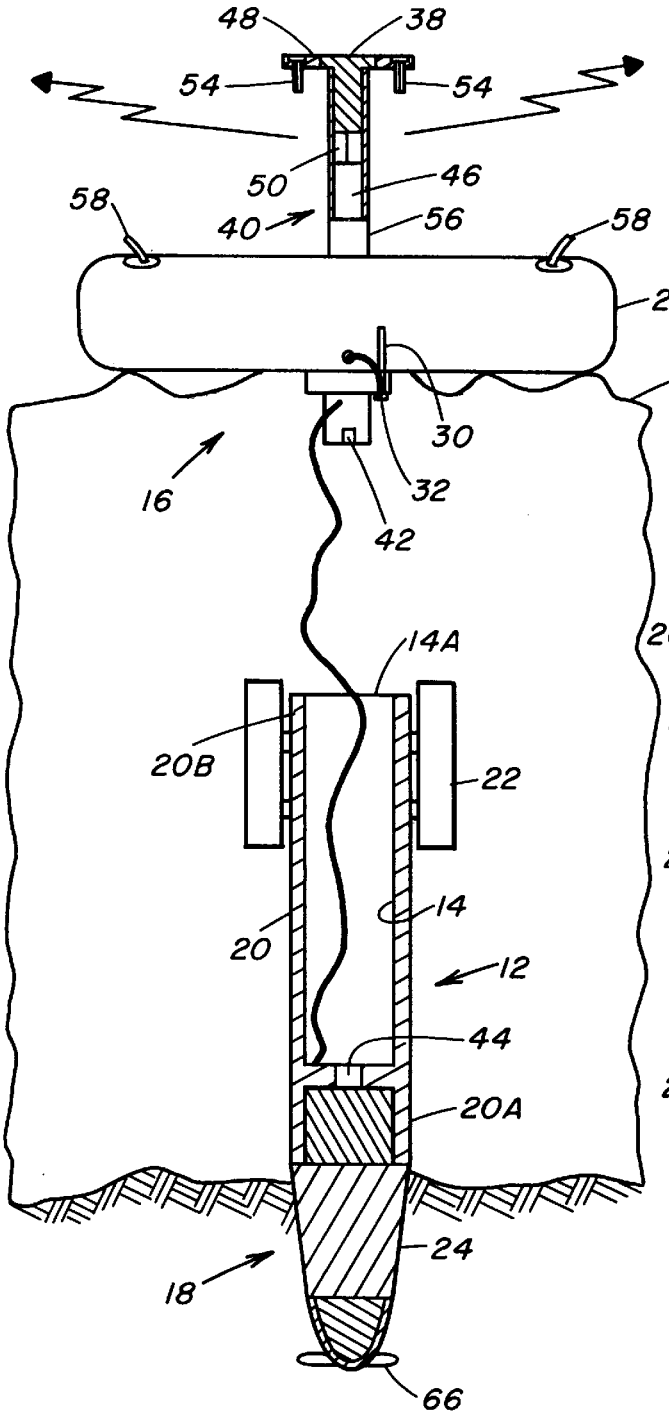
FIG. 2 is a longitudinal sectional view of the position marking device after deployment and arrival at a water-based location.
Figure 1:
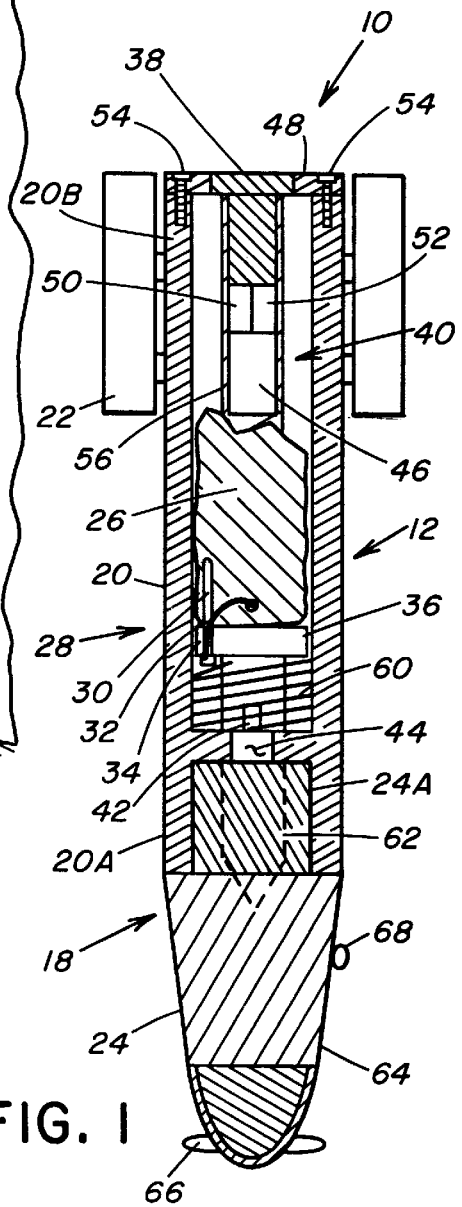
FIG. 1 is a longitudinal sectional view of an air-delivered position marking device in accordance with the present invention being shown before deployment.

Referring now to the drawings and particularly to FIGS. 1 and 2, there is illustrated an air-deliverable position marking device, generally designated 10, of the present invention. The position marking device 10 basically includes an elongated body 12 defining an interior chamber 14, a payload assembly 16 disposed in the interior chamber 14 of the elongated body 12, and a detonatable mechanism 18 provided in the elongated body 12 forwardly of and in communication with the interior chamber 14 thereof.

The elongated body 12 of the device 10 includes a main hollow case 20 of a generally cylindrical shape and having opposite forward and rearward ends 20A, 20B, the interior chamber 14 extending between the forward and rearward ends 20A, 20B and open at a rear end 14A, and a fin assembly 22 mounted on the rearward end 20B of the main hollow case 20 for providing stabilization of the flight of the device 10. Wing Kit can be used to extend range and delivery precision of the device. The elongated body 12 also includes a forward nose assembly 24 having a rear end 24A attached to the forward end 20A of the main hollow case 20. The elongated body 12 having a configuration similar to a conventional general purpose aircraft deployed bomb is connectable in a known manner to the bomb rack of the fixed wing aircraft and is released along with other ordnance.

The payload assembly 16 of the device 10 is removably disposed in the interior chamber 14 of the main hollow case 20 of the elongated body 12. The payload assembly 16 includes an inflatable flotation body 26 and an actuatable mechanism 28 coupled to the inflatable flotation body 26 for causing its inflation to cause, in turn, flotation of the payload assembly at the sea surface S when the desired marking location is on water. The inflatable flotation body 26 may take any suitable form such as an annular shaped flexible inflatable collar, as seen in FIG. 2. The actuatable mechanism 28 for causing inflation of the flotation body 26 may take any suitable form, such as at least one bottle 30 of a suitable pressurized gas, such as carbon dioxide, coupled to the flotation body 26 and at least one piercing pin 32 reciprocally mounted in a passageway 34 defined in a transverse bulkhead or platform 36 disposed in the interior chamber 14 forwardly of the flotation body 26. The pin 32 in the passageway 34 is aligned with the bottle 30. The passageway 34 is open to communication with the space between the platform 36 and the forward end 20A of the hollow main case 10. The piercing pin 32 is normally restrained by a spring (not shown) from moving toward and puncturing the bottle 30 to release the pressurized gas therefrom and inflate the flotation body 26. When the bottle 30 is punctured by the rearward movement of the pin 32, the flotation body 26 will inflate and buoy the payload assembly 16 to the sea surface S.

The payload assembly 16 further includes a GPS receiver and transmitter unit 38 and an electrical power source 40 coupled to the GPS receiver and transmitter unit 38. The electrical power source 40 preferably takes the form of a percussion battery 42 disposed in the space forwardly of the flotation body 26 between the platform 36 and the forward end 20A of the main case 20 and aligned with an opening 44 therein, and a thermal battery 46 disposed in the interior chamber 14 rearwardly of the flotation body 26 and connected to the percussion battery 42. The percussion and thermal batteries 42, 46 upon activation supply electrical power to operate GPS receiver and transmitter unit 38.

The payload assembly 16 additionally includes a closure 48 for the main hollow case 20 and a self-destruct charge 50 and destruct timer 52 connected to the self-destruct charge 50 and to the GPS receiver and transmitter unit 38 and powered from the thermal battery 46. The closure 48 is detachably attached by shear screws 54 to the rearward end 20B of the main hollow case 20 so as to close the open rear end 14A of the interior chamber 14 and to detach therefrom in response to generation of sufficient predetermined pressure in the interior chamber 14 of the main hollow case 20 to cause facture the shear screws 54. The destruct timer 52 when actuated detonates the self-destruct charge 50 and thereby destroys the GPS receiver and transmitter unit 38 after lapse of a predetermined period of time after actuation of the destruct timer 52 in response to generation of the pressure in the interior chamber 14 of the main hollow case 20.

Finally, the payload assembly 16 includes an elongated support member 56 connected to the platform 36 and centrally disposed in and extending through the interior chamber 14. The various above-described components of the payload assembly 16, namely, the inflatable flotation body 26, actuatable mechanism 28, GPS receiver and transmitter unit 38, electrical power source 40, closure 48, self-destruct charge 50 and destruct timer 52, are all mounted to the central support member 56 of the payload assembly 16 and ejected therewith from the interior chamber 14 in response to a predetermined pressure generated in the interior chamber 14 forwardly of the transverse platform 36 by the firing of the detonation mechanism 18.

The detonatable mechanism 18 of the device 10 is mounted in the forward nose assembly 24 of the elongated body 12 and is provided in communication with the interior chamber 14 of the main hollow case 20 via the opening 44 in the forward end 20A thereof. The firing of the detonatable mechanism 18, either due to surface impact with the sea or land or due to an encoded firing signal transmission (as will be explained below), generates a predetermined pressure in the interior chamber 14 of the main case 20 of the elongated body 12. The pressure buildup in the interior chamber 14 causes failure of the shear screws 54 and ejection of the payload assembly 16 from the interior chamber 14 via the open rear end 14 thereof. The pressure buildup in the interior chamber 14 concurrently causes the pin 32 to puncture the bottle 30 and initiate the inflation of the flotation body 26 and causes the percussion battery 42 to activate the thermal battery 46 and initiate communications between the GPS receiver and transmitter unit 38 and a remote station, being a GPS satellite, to accurately determine the position of the position marking device 10 at the desired location. The receiver of the GPS unit 38 fixes the position of the device 10 from the GPS satellite transmissions and the transmitter of the GPS unit 38 broadcasts the position to naval forces effectively marking the location of the emplaced device 10. The flotation body 26 has scuttle valves 58 thereon which bleed off the pressurizing gas and after a given time the flotation body 26 deflates and the payload assembly 16 sinks. The destruct timer 52 after expiration of its predetermined time period activates the self-destruct charge 50 to destroy the GPS receiver and transmitter unit 38 in order to prevent it from being retrieved at a later time by adversary forces. A similar sequence is followed on land, as opposed to in the sea, with the exceptions that the flotation body 26 does not serve to buoy the payload assembly 16 nor does the elongated body 12 sink to anchor the payload assembly 16. However, the payload assembly 16 is still expelled from the interior chamber 14 by the pressure generated therein by the detonator mechanism 18 and the flotation body 26 still is inflated by the actuatable mechanism 28. All other sequences and mechanisms work the same. An elongated flexible tether 60 is disposed in the interior chamber 14 in the space between the platform 36 and forward end 20A of the main case 20. The tether 60 is attached to and extends between the support member 56 of the payload assembly 16 and the main case 20 of the elongated body 12. When the device 10 is employed to mark a water-based location, such as in the ocean or sea, the payload assembly 16, after ejection from the interior chamber 14 of the elongated body 12 and with the flotation body 26 inflated, becomes a buoy which is anchored to the sunken elongated body 12 by the tether 60, as shown in FIG. 2.

More particularly, the detonation mechanism 18 includes a rear detonation charge 62 disposed in the rear end 24A of the forward nose assembly 24 in communication with the space in the forward end of the interior chamber 14 via the opening 44 in the forward end 20A of the main case 20. The detonation mechanism 18 also includes a front arming device 64 disposed in the forward nose assembly 24 forwardly of the rear detonatable charge 62 and coupled thereto. The front arming device 64 includes, among other components, an arming vane 66, and an impact detonating fuze and point detonating firing pin, the latter two components being shown only in block form in FIG. 1 in view that their makeup is well-known to those of ordinary skill in the art. The impact detonating fuze and point detonating firing pin are activatable from an unarmed condition to an armed condition upon removal of an arming pin 68 with the release and launch of the device 10 from a carrier aircraft and upon rotation of the arming vane 66 in response to flight of the device 10 to a desired marking location. In the armed condition, the impact detonating fuze and point detonating firing pin of the front arming device 64 are disposed in a firing alignment with the rear detonation charge 62. At surface impact, either with water or land, the nose on the fuze is crushed and the fuze firing pin impacts and fires a primer which, in turn, fires the rear detonation charge 62 generating the desired predetermined pressure in the front space in the interior chamber 14. As explained earlier, firing of the rear detonation charge 62 creates the predetermined pressure in the forward end of the interior chamber 14 which causes the screws 54 to shear and separates the closure 48 from the rearward end 20B of the main case 20 and ejects the payload assembly 16 from the interior chamber 14. The detonation of the rear detonation charge 62 also creates sufficient pressure in the platform passageway 34 to cause the piercing pin 32 to move rearwardly and pierce the bottle 30, which results in inflating the flotation body or collar 26 which by now has been ejected from the interior chamber 14 with the support member 56 and platform 36 of the payload assembly 16. Furthermore, the detonation provides sufficient impetus to cause the percussion battery 42 to activate the thermal battery 46.

Alternatively, for instances where it is desired to be able to perform position marking of a sea lane after anti-mine ordnance has been detonated, the front arming device 64 can alternatively be implemented by a well-known prior art MK32 arming device in conjunction with other components that are responsive to an encoded signal, such as an encrypted magnetic signal magneto-inductive 5–550 Hz, generated from a remote signal transmitter, such as a standoff transmitter located at a standoff control station. The encoded signal causes detonation of the rear detonation charge 62 of the detonation mechanism 18, via the front arming device 64.

Figure 3:
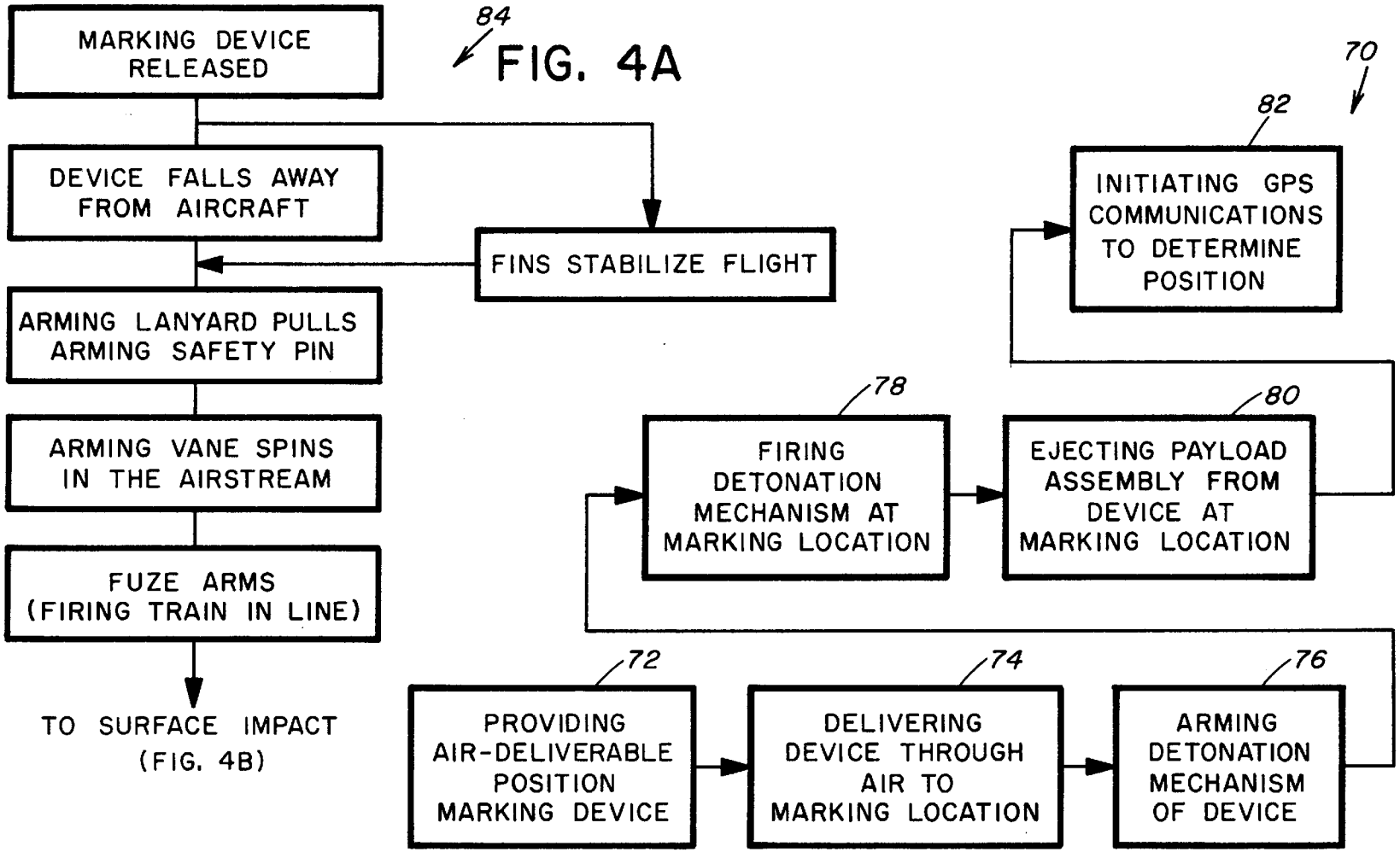
FIG. 3 is a general flow diagram of a position marking method in accordance with the present invention.

Referring to FIG. 3, there is illustrated in a general flow diagram, generally designated 70, the basic steps of the method of the present invention for marking the position using the position marking device 10. As per block 72 of the flow diagram 70, the air-deliverable device 10 of FIG. 1 is provided for marking accurately its position using GPS technology. As per block 74 of the flow diagram 70, the device 10 being carried by an aircraft is launched into flight and delivered through the air to a desired marking location. As per block 76 of the flow diagram 70, the detonation mechanism 18 of the device 10 is armed in response to the launching of the device 10 into flight. As per block 78 of the flow diagram 70, the detonation mechanism 18 is fired either in response to the device 10 reaching the desired location or at a desired moment thereafter depending on the type of detonation mechanism used as explained earlier. The firing of the detonation mechanism 18 generates the desired predetermined pressure in the front end of the interior chamber 14 of the elongated body 12 of the device 10 that also contains the payload assembly 16. As per block 80 of the flow diagram 70, in response to generation of the predetermined pressure in the interior chamber 14, the inflation of the flotation body 26 is initiated resulting in buoyancy of the inflating floatation causing the payload assembly 16 to be ejected from the interior chamber 14. As per block 82 of the flow diagram, communications between the GPS receiver and transmitter unit 32 and a remote station, such as a GPS satellite, is initiated by the thermal battery 46 in response to generation of the predetermined pressure, to accurately determine the position of the position marking device 10 at the desired location.

Figure 4B:
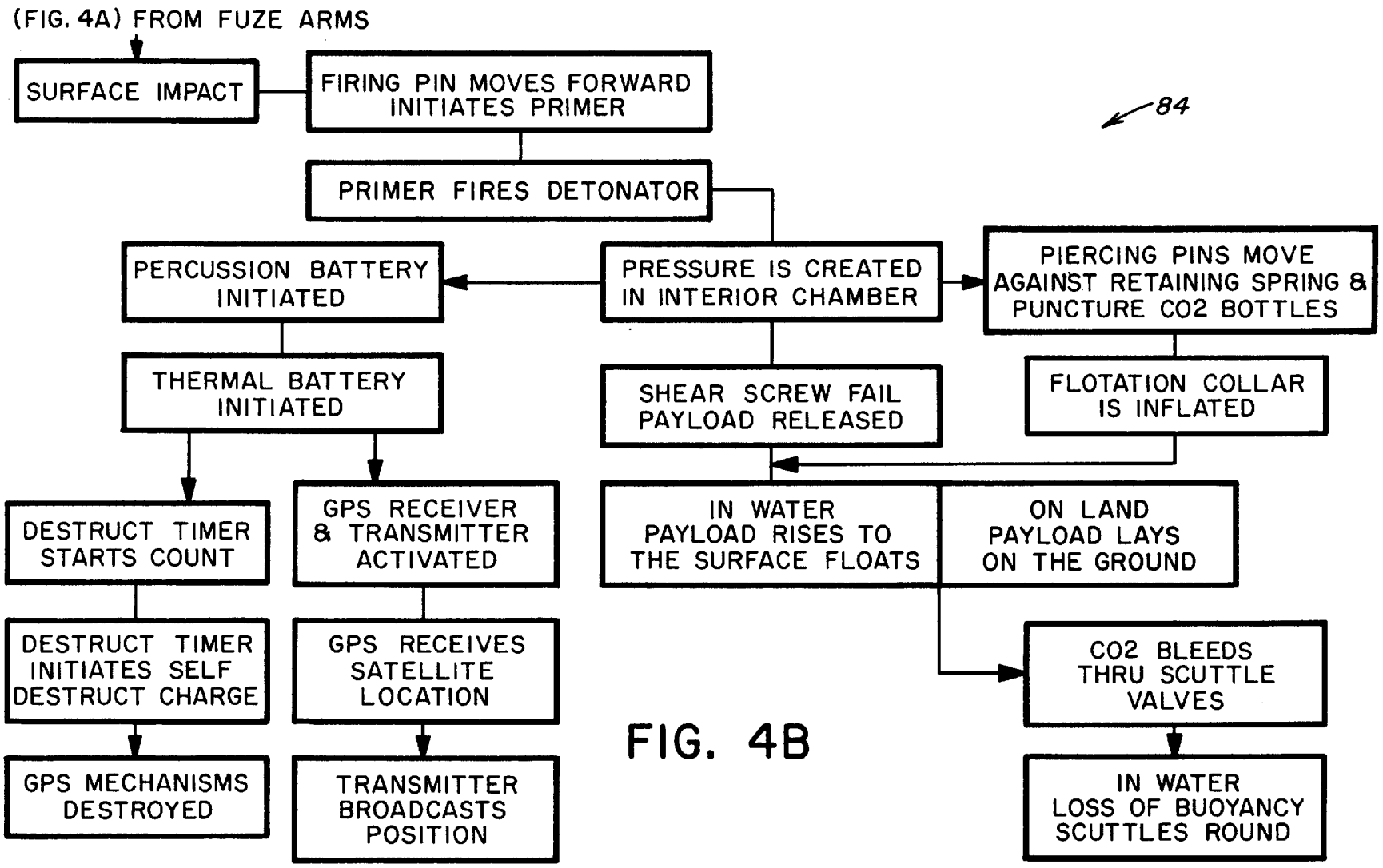

Referring now to FIGS. 4A and 4B, together there is illustated a detailed flow diagram, generally designated 84, of the operational steps of the position marking method of the present invention employing the device 10 of FIGS. 1 and 2. In view that these operational steps have been described above in detail with the description of the components of the detonation mechanism 18 and payload assembly 16 and their mode of operation and further in view that these steps are presented again in the detailed flow diagram 84 in a substantially self-explanatory manner, there is no need now for further description hereinafter.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An air-deliverable position marking device, comprising:

(a) an elongated body defining an interior chamber;

(b) a fin assembly mounted on said elongated body for providing stabilization of flight of said device;

(c) a payload assembly disposed in said interior chamber of said elongated body and including an inflatable flotation body, an actuatable mechanism coupled to said flotation body for inflating said flotation body, a global positioning system (GPS) receiver and transmitter unit, and an electrical power source coupled to said GPS receiver and transmitter unit and being activatable for supplying electrical power to operate said GPS receiver and transmitter unit; and (d) a detonatable mechanism provided in said elongated body in communication with said interior chamber thereof such that firing of said detonatable mechanism generates a predetermined pressure in said interior chamber of said elongated body that causes ejection of said payload assembly from said interior chamber, actuates said actuatable mechanism to initiate inflation of said flotation body, and activates said electrical power source to initiate communications between said GPS receiver and transmitter unit and a remote station to determine the position of said position marking device at the desired location.

2. The device of claim 1 wherein said elongated body includes a main case having forward and rearward ends and defining said interior chamber extending between said forward and rearward ends and open at a rear end.

3. The device of claim 2 wherein said payload assembly also includes a closure detachably attached to said rearward end of said main case to close said rear end of said interior chamber and to detach therefrom in response to generation of said pressure in said interior chamber of said elongated body.

4. The device of claim 3 wherein said payload assembly further includes an elongated support member disposed in said interior chamber and mounting said inflatable flotation body, actuatable mechanism, GPS receiver and transmitter unit, electrical power source, and closure.

5. The device of claim 1 further comprising:

an elongated flexible tether disposed in said interior chamber of said elongated body and attached to and extending between said payload assembly and said elongated body such that when said device is marking the position of a water-based location said payload assembly after ejection from said elongated body and with said flotation body inflated becomes a buoy which is anchored to said elongated body by said tether.

6. An air-deliverable position marking device, comprising:

(a) an elongated body defining an interior chamber;

(b) a payload assembly disposed in said interior chamber of said elongated body and including an inflatable flotation body, an actuatable mechanism coupled to said flotation body for inflating said flotation body, a global positioning system (GPS) receiver and transmitter unit, and an electrical power source coupled to said GPS receiver and transmitter unit and being activatable for supplying electrical power to operate said GPS receiver and transmitter unit; and (c) a detonatable mechanism provided in said elongated body in communication with said interior chamber thereof such that firing of said detonatable mechanism generates a predetermined pressure in said interior chamber of said elongated body that causes ejection of said payload assembly from said interior chamber, actuates said actuatable mechanism to initiate inflation of said flotation body, and activates said electrical power source to initiate communications between said GPS receiver and transmitter unit and a remote station to determine the position of said position marking device at the desired location;

(d) said detonation mechanism including a rear detonation charge disposed in communication with a forward end of said interior chamber of said elongated body and a front arming device disposed forwardly of said rear detonation charge and connected thereto, said front arming device being activatable from an unarmed condition to an armed condition in firing alignment with said rear detonation charge in response to launching of said device into flight to the desired location.

7. The device of claim 6, further comprising:

a forward nose assembly having a rear end attached to said forward end of said main case, said front arming device and said rear detonatable charge being disposed in said forward nose assembly.

8. An air-deliverable position marking device, comprising:

(a) an elongated body defining an interior chamber;

(b) a payload assembly disposed in said interior chamber of said elongated body and including an inflatable flotation body, an actuatable mechanism coupled to said flotation body for inflating said flotation body, a global positioning system (GPS) receiver and transmitter unit, and an electrical power source coupled to said GPS receiver and transmitter unit and being activatable for supplying electrical power to operate said GPS receiver and transmitter unit; and (c) a detonatable mechanism provided in said elongated body in communication with said interior chamber thereof such that firing of said detonatable mechanism generates a predetermined pressure in said interior chamber of said elongated body that causes ejection of said payload assembly from said interior chamber, actuates said actuatable mechanism to initiate inflation of said flotation body, and activates said electrical power source to initiate communications between said GPS receiver and transmitter unit and a remote station to determine the position of said position marking device at the desired location;

(d) said payload assembly further including a self-destruct charge connected to said GPS receiver and transmitter unit and a destruct timer connected to said self-destruct charge and being actuatable in response to generation of said pressure in said interior chamber of said elongated body to detonate said self-destruct charge and thereby destroy said GPS receiver and transmitter unit after lapse of a predetermined period of time after actuation of said destruct timer in response to generation of said pressure.

9. An air-deliverable position marking device, comprising:

(a) an elongated body including (i) a main case having forward and rearward ends, an interior chamber extending between said forward and rearward ends and open at a rear end, and a fin assembly mounted on said rearward end of said main case for providing stabilization of flight of said device, and (ii) a forward nose assembly having a rear end attached to said forward end of said main case;

(b) a payload assembly disposed in said interior chamber of said elongated body and including an inflatable flotation body, an actuatable mechanism coupled to said flotation body for inflating said flotation body, a global positioning system (GPS) receiver and transmitter unit, and an electrical power source coupled to said GPS receiver and transmitter unit and being activatable for supplying electrical power to operate said GPS receiver and transmitter unit; and (c) a detonatable mechanism provided in said forward nose assembly of said elongated body in communication with said interior chamber of said main case such that firing of said detonatable mechanism generates a predetermined pressure in said interior chamber that causes ejection of said payload assembly from said interior chamber, actuates said actuatable mechanism to initiate inflation of said flotation body, and activates said electrical power source to initiate communications between said GPS receiver and transmitter unit and a remote station to determine the position of said position marking device at the desired location, said detonation mechanism including a rear detonation charge disposed in communication with a forward end of said interior chamber and a front arming device disposed forwardly of said rear detonatable charge and connected thereto, said front arming device being activatable from an unarmed condition to an armed condition in firing alignment with said rear detontable charge in response to launching of said device into flight to the desired location.

10. The device of claim 9 wherein said payload assembly also includes a closure detachably attached to said rearward end of said main case to close said rear end of said interior chamber and to detach therefrom in response to generation of said pressure in said interior chamber of said elongated body.

11. The device of claim 10 wherein said payload assembly further includes an elongated support member disposed in said interior chamber and mounting said inflatable flotation body, actuatable mechanism, GPS receiver and transmitter unit, electrical power source, and closure.

12. The device of claim 9 further comprising:

an elongated flexible tether disposed in said interior chamber of said elongated body and attached to and extending between said payload assembly and said elongated body such that when said device is marking the position of a water-based location said payload assembly after ejection from said elongated body and with said flotation body inflated becomes a buoy which is anchored to said elongated body by said tether.

13. The device of claim 9 wherein said payload assembly further includes:

a self-destruct charge connected to said GPS receiver and transmitter unit; and a destruct timer connected to said self-destruct charge and being actuatable in response to generation of said pressure in said interior chamber of said elongated body to detonate said self-destruct charge and thereby destroy said GPS receiver and transmitter unit after lapse of a predetermined period of time after actuation of said destruct timer in response to generation of said pressure.

14. The device of claim 13 wherein said self-destruct charge and destruct timer are mounted to said elongated support member of said payload assembly.

15. A global positioning system (GPS) position marking method, comprising the steps of:

(a) providing an air-deliverable position marking device;

(b) launching the device into flight through the air to a desired location;

(c) arming the device in response to launching the device into flight;

(d) firing a detonation mechanism contained in the device when the device is at the desired location so as to generate a predetermined pressure in an interior chamber of the device that contains a payload assembly; and (e) in response to generation of the predetermined pressure in the interior chamber of the device, ejecting the payload assembly from the interior chamber of the device, initiating inflation of an inflatable flotation body of the payload assembly, and initiating communications between a GPS receiver and transmitter unit of the payload assembly and a remote station to determine the position of the position marking device at the desired location.

16. The method of claim 15 wherein said device is provided with an elongated body including an interior chamber and a payload assembly disposed in said interior chamber and including an inflatable flotation body, an actuatable mechanism coupled to said flotation body for inflating said flotation body, a global positioning system (GPS) receiver and transmitter unit, and an electrical power source coupled to said GPS receiver and transmitter unit and being activatable for supplying electrical power to operate said GPS receiver and transmitter unit.

17. The method of claim 16 wherein said device is also provided with a detonatable mechanism mounted to said elongated body and provided in communication with said interior chamber thereof such that said firing of said detonatable mechanism generates said pressure in said interior chamber of said elongated body that causes said ejecting of said payload assembly from said interior chamber, said actuating of said actuatable mechanism to initiate inflation of said flotation body, and said activating of said electrical power source to initiate communications between said GPS receiver and transmitter unit and a remote station to determine the position of said device at the desired location.

18. The method of claim 16 further comprising the step of:

attaching an elongated flexible tether to and between said elongated body and said payload assembly such that when said device is marking the position of a water-based location said payload assembly after ejection from said elongated body and with said flotation body inflated becomes a buoy which is anchored to said elongated body by said tether.

19. The method of claim 15 further comprising the steps of:

connecting a self-destruct charge to said GPS receiver and transmitter unit; and connecting a destruct timer to said self-destruct charge and actuating said self-destruct charge in response to generation of said pressure in said interior chamber of said elongated body to detonate said self-destruct charge and thereby destroy said GPS receiver and transmitter unit after lapse of a predetermined period of time after actuation of said destruct timer in response to generation of said pressure.

* * * * *